US006132951A

United States Patent [19]

Ezure et al.

[11] Patent Number: 6,132,951

[45] Date of Patent: Oct. 17, 2000

[54] PHOTOGRAPHIC SUPPORT AND PHOTOGRAPHIC MATERIAL

[75] Inventors: Hidetoshi Ezure; Masahito Takada; Kenji Ohnuma; Yasuo Kurachi, all of Hino, Japan

[73] Assignee: Konica Corporation, Tokyo, Japan

[21] Appl. No.: 09/222,427

[22] Filed: Dec. 29, 1998

[30] Foreign Application Priority Data

Jan. 12, 1998 [JP] Japan ..... 10-016338

[51] Int. Cl.[7] ..... G03C 1/047

[52] U.S. Cl. ..... 430/627; 430/635; 430/637; 430/533; 430/930; 428/480

[58] Field of Search ..... 430/627, 635, 430/637, 533, 930; 428/480

[56] References Cited

U.S. PATENT DOCUMENTS 5,472,831 12/1995 Nishiura et al. ..... 430/930
5,580,707 12/1996 Kawamoto ..... 430/930
5,698,329 12/1997 Robinson ..... 430/627
5,858,507 1/1999 Yoshida et al. ..... 428/141
5,866,282 2/1999 Bourdelais et al. ..... 430/930
5,968,666 10/1999 Carter et al. ..... 428/480

*Primary Examiner*—Richard L. Schilling
*Assistant Examiner*—Amanda C. Walke
*Attorney, Agent, or Firm*—Frishauf, Holtz, Goodman, Langer & Chick, P.C.

[57] ABSTRACT

Provided is a photographic support which is excellent in mechanical strength and is less liable to get into roll set curl and which is excellent in cutting property and flatness, and a photographic material using the same. The support for photographic material comprises a polyester film, wherein the polyester film comprises two kinds of polyester resins, each has intrinsic viscosity of 0.2–1.2, and a difference in the intrinsic viscosity between the polyester resins is 0.1–1.0.

22 Claims, No Drawings

PHOTOGRAPHIC SUPPORT AND PHOTOGRAPHIC MATERIAL

BACKGROUND OF THE INVENTION

1. Field of the Invention

The present invention relates to a photographic support and a photographic material, more specifically to a photographic support comprising a biaxially stretched polyester film which is excellent in transparency and mechanical strength and is reduced in roll set curl, and a photographic material using the same, and particularly to a photographic support which does not have coating faults in providing a subbing layer and a back layer, which are liable to occur by heat treatment carried out on a roll for reducing roll set curl, and a photographic material using the same.

2. Related Art

In light of convenience in carrying and easiness in handling, further miniaturization is desired to cameras and in promoting the miniaturization, a storage space for a photographic film to be loaded has to be indispensably compact. Usually, a photographic film in which a roll film has been wound on a spool is loaded, and therefore the thickness of the photographic film itself has to be reduced in order to make the space therefor compact and secure a fixed number of photographing sheets (for example, 36 photographing sheets). In particular, a triacetyl cellulose (TAC) film which is a support for a photographic film has a thickness of an extent of 120 to 125 $\mu$m even at present and is pretty thick as compared with the thickness (extent of 20 to 30 $\mu$m) of a light-sensitive layer provided thereon. Accordingly, a reduction in the thickness of this support is considered the most effective means for reducing the total thickness of the photographic film. On the other hand, since a TAC film has intrinsically a weak mechanical strength, the smaller thickness than existing one reduces the strength, and therefore if the support has a film thickness of 100 $\mu$m or less, edge folding occurs at a perforation part at both ends of the film when developing a light-sensitive material using it in a cinema type development treating machine, so that it has not stood practical use.

On the other hand, a polyethylene terephthalate (PET) support has so far been known as a support and used for X-ray films and plate making films. A PET support has an excellent strength and therefore is considered to be applied to a color negative film as well. However, while the PET support has an excellent strength, it has as low glass transition temperature as about 70° C. and therefore has heavy roll set curl formed when the film is stored over a long period of time in a wound state under a high temperature atmosphere at about 60° C. corresponding to the storage conditions in the summer season. Accordingly, the PET support has the defects that it is inferior in roll set curl and a handling property in a processing machine before development processing and has such inferior roll set curl removability that the roll set curl is scarcely removed after the development processing, so that it has not stood practical use.

On the other hand, known in Japanese Provisional Patent Publication No. Hei 6-35118/1994 and 6-35115/1994 are light-sensitive materials using polyethylene naphthalate which has been less liable to have roll set curl by subjecting a polyester film to heat treatment (hereinafter referred to as annealing treatment, for short, AN) at a temperature of the glass transition temperature (Tg) or lower in a wound state in order to improve the roll set curl after processing.

It is well known, however, that when various films including polyethylene terephthalate films are heated to the vicinity of Tg's thereof, the elastic moduli are suddenly reduced. Accordingly, if a thermoplastic resin film is subjected to heat treatment in the vicinity of a Tg thereof over an extended period of time under the condition that a large load is applied, the film does not stand the load, so that crinkles, folding and pressing are produced. Even if such faults on the surface are so fine that they can not be seen with eyes, it results in visible coating fault and inferior flatness of the film by subsequent coating steps for a subbing layer and a back layer. Accordingly, the existing film is that it can not stand use in a photographic support.

On the other hand, a light-sensitive layer of a photographic film contains gelatin as a component and has a weaker strength than that of a polyethylene terephthalate film. In addition thereto, a film containing polyethylene naphthalate disclosed in the publications mentioned above has intrinsically a strong strength and is liable to be cut in the form of delamination. Accordingly, the film has such a remarkably inferior cutting property that when the film is cut and processed to the form of a finished product after providing light-sensitive layers on this film, brought about is the problem that a cutting direction in cutting the film is deviated from a running direction of cracks caused in cutting to cause peeling and cracking of the light-sensitive layers, so that it has not stood practical use.

SUMMARY OF THE INVENTION

Accordingly, an object of the present invention is to provide a photographic support which is excellent in mechanical strength and is less liable to get into roll set curl and which is excellent in cutting property and flatness, and a photographic material using the same.

The above object of the present invention can be achieved by:

1. A support for photographic material comprising a polyester film, wherein the polyester film comprises 2 kinds of polyester resins, each has intrinsic viscosity of 0.2–1.2, a difference in the intrinsic viscosity between the polyester resins is 0.1–1.0,
2. a support for photographic material comprising a biaxially stretched polyester film, wherein two kinds of the same or different polyester resins having an intrinsic viscosity of 0.2 to 1.2 inclusive and a difference in the intrinsic viscosities of 0.1 to 1.0 inclusive are blended,
3. the support as described in the above item 1 or 2, wherein at least one of the polyester resins described above is polyethylene-2,6-naphthalate,
4. the support as described in any of the above 1–3, wherein among the polyester resins described above, the polyester resin having a lower intrinsic viscosity is blended in an amount of 10% by weight or more to 50% by weight or less based on the total weight of the polyester resins,
5. the support as described in any of the above items 1 to 4, wherein the polyester resin having a lower intrinsic viscosity has an intrinsic viscosity of 0.5 or less,
6. the support as described in any of the above items 1 to 5, wherein both of the polyester resins described above are polyethylene-2,6-naphthalate, and
7. A photographic material characterized by using the photographic support as described in any of the above items 1 to 6.

DESCRIPTION OF THE PREFERRED EMBODIMENTS

The present invention shall be explained below in detail.

The polyester resins forming the biaxially stretched polyester film of the present invention shall not specifically be restricted as long as it is prepared by blending two kinds of the same or different polyesters having an intrinsic viscosity of 0.2 to 1.2 inclusive and a difference of 0.1 to 1.0 inclusive in the intrinsic viscosities. They are preferably polyester resins comprising a dicarboxylic acid component and a diol component as principal structural components and having a film-forming property.

With respect to the above-mentioned "the same or different polyesters", the term "the same" means such a case where all kinds of components constituting both polyesters are completely the same but one of the polyesters may have a degree of polymerization and/or a ratio of components constituting the polyester different from the other, and the term "different" means such a case where one or more kinds of components constituting one of the polyester is/are different from the other.

The dicarboxylic acid component which is a principal structural component includes terephthalic acid, isophthalic acid, phthalic acid, 2,6-naphthalenedicarboxylic acid, 2,7-naphthalenedicarboxylic acid, diphenylsulfonedicarboxylic acid, diphenyletherdicarboxylic acid, diphenylethanedicarboxylic acid, cycloheanedicarboxylic acid, diphenyldicarboxylic acid, diphenylthioetherdicarboxylic acid, diphenylketonedicarboxylic acid, and phenylinedandicarboxylic acid. The diol component includes ethylene glycol, propylene glycol, tetramethylene glycol, cyclohexanedimethanol, 2,2-bis(4-hydroxyphenyl)propane, 2,2-bis(4-hydroxyethoxyphenyl)propane, bis(4-hydroxyphenyl) sulfone, bisphenolfluorenedihydroxyethyl ether, diethylene glycol, neopentyl glycol, hydroquinone and cyclohexanediol.

Among the polyester resins in which they are principal structural components, preferred in terms of transparency, mechanical strength and dimensional stability and so on are polyester resins comprising as principal structural components terephthalic acid and/or 2,6-naphthalenedicarboxylic acid as a dicarboxylic component and ethylene glycol and/or 1,4-cyclohexanedimethanol as a diol component.

Among them, preferred are a polyester resins comprising polyethylene terephthalate or polyethylene 2,6-naphthalenedicarboxylate as a principal structural component, a copolymerized polyester resins comprising terephthalic acid, 2,6-naphthalenedicarboxylic acid and ethylene glycol, and a polyester comprising a mixture of two or more kinds of these polyester resins as a principal structural component. Particularly preferred is a polyester resin comprising polyethylene 2,6-naphthalenedicarboxylate as a principal structural component.

The polyester resin of the present invention to be mixed has preferably an intrinsic viscosity of 0.2 to 1.2 inclusive. If the intrinsic viscosity is less than 0.2, the polymerization degree is low, and therefore the film forming property and the strength are not raised. On the other hand, if it is more than 1.2, solid phase polymerization over a long period of time is required, and therefore the cost becomes high. Accordingly, both are not preferred. From the viewpoint described above, more preferred intrinsic viscosity of the polyester resin of the present invention is 0.3 to 1.0 inclusive.

The difference between the intrinsic viscosities of the polyester resins to be mixed is preferably as large as possible in order to enhance the effects of the present invention. However, the intrinsic viscosity of one resin is due to be raised in order to enlarge the difference between the intrinsic viscosities, and therefore the upper limit of the intrinsic viscosity inevitably restricts the range thereof. From the viewpoint described above, the difference between the intrinsic viscosities of the polyester resins of the present invention is preferably 0.1 to 1.0 inclusive, more preferably 0.2 to 0.7 inclusive.

In the blending ratio of the polyester resins of the present invention, the polyester resin having a lower intrinsic viscosity accounts preferably for 10 to 50% by weight, particularly preferably 10 to 30% by weight, based on the total weight of the polyester resins. When the polyester resin having a lower intrinsic viscosity has a higher blending ratio, the effect of the present invention is reduced.

The polyester resin forming the biaxially stretched polyester film of the present invention may further be copolymerized with other compolymerizable components or may be mixed with other polyester resins as long as the effects of the present invention are not damaged. Examples thereof include the dicarboxylic acid components and diol components described above and polyester resins comprising them.

In order to cause delamination of the film to be less liable to take place, the polyester resin forming the biaxially stretched polyester film of the present invention may be copolymerized with aromatic dicarboxylic acids having a sulfonate group or ester-forming derivatives thereof, dicarboxylic acids having a polyoxyalkylene group or ester-forming derivatives thereof and diols having a polyoxyalkylene group.

Among them, preferred in terms of polymerization reactivity of the polyester and transparency of the film are 5-sodium sulfoisophthalic acid, 2-sodium sulfoterephthalic acid, 4-sodium sulfophthalic acid, 4-sodium sulfo-2,6-phthalenedicarboxylic acid and compounds obtained by substituting these sodiums with other metals (for example, potassium, lithium and the like), an ammonium salt and a sulfonium salt or ester-forming derivatives thereof, polyethylene glycol, polytetramethylene glycol, polyethylene glycol-polypropylene glycol copolymers and compounds obtained by oxidizing hydroxy groups at both ends thereof to convert them into carboxyl groups.

A proportion of the copolymerization for this purpose is preferably 0.1 to 10 mole % based on the difunctional dicarboxylic acids forming the polyester.

Further, a bisphenol A compound and a compound having a naphthalene ring or a cyclohexane ring can be copolymerized for the purpose of improving the heat resistance of the film. A proportion thereof in the copolymerization is preferably 1 to 20 mole % based on the difunctional dicarboxylic acids forming the polyester.

An antioxidant may be contained in the polyester resin of the present invention. In particular, the effect is notably displayed when the polyester contains a compound having a polyoxyalkylene group. The kind of the antioxidant to be added shall not specifically be restricted, and various antioxidants can be used. They include antioxidants such as, for example, hindered phenol series compounds, phosphite series compounds and thioether series compounds. Among them, the anitoxidants of the hindered phenol series compounds are preferred in terms of transparency.

Usually, the content of the antioxidant is preferably 0.01 to 2% by weight, more preferably 0.1 to 0.5% by weight based on the weight of the polyester resin. A so-called fogging phenomenon in which a photographic light-sensitive material has a raised density in an unexposed part can be prevented and the haze of the film is inhibited by causing the content of the antioxidant to fall in this range, so that a photographic support having an excellent transparency can be obtained. It is a matter of course that these antioxidants may be used alone or in combination of two or more kinds thereof.

A dye is preferably contained in the polyester resin of the present invention for the purpose of preventing a light piping phenomenon. Dyes blended for such purpose shall not specifically be restricted, but they have to be excellent in a heat resistance in terms of production of the film and include anthraquinone series and perynone series dyes. The color tone thereof is preferably grey color as is the case with conventional light-sensitive materials. MACROLEX series manufactured by Bayer Co., Ltd., SUMIPLAST series manufactured by Sumitomo Chemical Ind. Co., Ltd. and Diaresin series manufactured by Mitsubishi Chemical Co., Ltd. can be used for these dyes alone or by mixing two or more kinds of the dyes so that a required color tone is obtained.

In this case, the spectral transmission factor of the film is controlled preferably to 60% to 85% inclusive in a wavelength range of 400 to 700 nm, and it is preferred for preventing the light piping phenomenon and obtaining a good photographic print to use the dye so that a difference between the maximum and minimum spectral transmission factors in a wavelength range of 600 to 700 nm falls within 10%.

The biaxially stretched polyester film of the present invention can be provided, if necessary, with a sliding property. A sliding property-providing means shall not specifically be restricted and includes usually an external particle addition method in which inactive inorganic particles are added to a polyester resin, an internal particle deposition method in which a catalyst added in synthesizing polyester is deposited and a method in which a surfactant is applied on the surface of the film.

Among them, the internal particle deposition method by which the deposited particles can be controlled to relatively small sizes is preferred since the sliding property can be provided without damaging the transparency of the film. Conventionally known various catalysts can be used for the catalyst. In particular, the use of Ca and Mn can provide the high transparency and therefore is preferred. These catalysts may be used alone or in combination of two or more kinds thereof.

The biaxially stretched polyester film of the present invention may be of a multilayer structure comprising heterogeneous polyester resins. For example, a layer comprising a mixture of the polyester resins of the present invention shall be designated as an A layer, and a layer comprising other polyesters shall be designated as a B layer or a C layer. Then, the above film may be of a two layer structure in which the film comprises the A layer and the B layer or a three layer structure in which the film comprises the A layer/B layer/A layer, the A layer/B layer/C layer, the B layer/A layer/B layer or the B layer/A layer/C layer. It is a matter of course that the structure of four or more layers can be taken, but it is not preferred so much in terms of practical use since the production facilities shall be complicated. The A layer has preferably a thickness accounting for 30% or more, more preferably 50% or more based on the whole thickness of the polyester film.

The transparency, the mechanical strength and the dimensional stability of the whole film can be improved by using as the polyester resin forming the B layer or the C layer, polyethylene terephthalate, polyethylene naphthalenedicarboxylate, other homopolyesters or other copolymerized polyesters which are excellent in transparency, mechanical strength and dimensional stability.

Further, when the biaxially stretched polyester film of the present invention has a multilayer structure, functions such as the oxidation inhibition, light piping prevention and sliding property described above may be provided or various additives other than those described above may be added only to the surface layer, and therefore the transparency of the film can highly be maintained.

A synthesis process for the polyester which is the raw material of the biaxially stretched polyester film of the present invention shall not specifically be restricted, and it can be produced according to conventionally known production processes. There can be used, for example, a direct esterification process in which a dicarboxylic acid component is subjected directly to esterification reaction with a diol component and a transesterification process in which dialkyl ester is first used as a dicarboxylic acid component to be subjected to transesterification reaction with a diol component, and this reaction product is heated under reduced pressure to remove the surplus diol component, whereby the polymerization is carried out. In this case, a transesterification catalyst or a polymerization reaction catalyst can be used or a heat resistant stabilizer can be added, if necessary.

Further, there may be added at the respective steps in the synthesis, a coloring preventive, an antioxidant, a crystalline nucleus agent, a sliding agent, a stabilizer, a blocking inhibitor, a UV absorber, a viscosity controlling agent, a defoaming agent, a clarification agent, an antistatic agent, a pH controlling agent, a dye and a pigment and so on.

The thickness of the biaxially stretched polyester film of the present invention shall not specifically be restricted. It can be set up so that the needed strength is provided according to use purposes thereof. Particularly when the film is used for a color negative photographic light-sensitive material, the thickness is preferably 20 to 125 $\mu$m, particularly preferably 40 to 90 $\mu$m. Further, when the film is used for a medical or printing photographic light-sensitive material, the thickness is preferably 50 to 200 $\mu$m, particularly preferably 60 to 150 $\mu$m. If the thickness is smaller than this range, the required strength can not be obtained in a certain case. On the other hand, the larger thickness results in canceling predominance over conventional supports for a photographic light-sensitive material.

It is preferred for obtaining a light-sensitive material which does not bring about problems such as formation of scratches and blurred focus at a step of printing on a photographic paper to provide the biaxially stretched polyester film of the present invention with curl in a lateral direction. In this case, the effect of curl is displayed when the film is provided with a photographic light-sensitive layer on the convex side of the curl and wound with the surface thereof inside.

The degree of the curl given to the film for such purpose can not be indiscriminately determined since it varies depending on a thickness, an elastic modulus and a hygroscopic swelling factor of the photographic light-sensitive layer to be provided. The curl is provided so that when a light-sensitive material is prepared from the film, the light-sensitive material becomes flat as much as possible in a range where a light-sensitive layer side does not become convex. Usually, it is preferably 5 $m^{-1}$ to 50 $m^{-1}$ under the condition of 23° C. and 20% RH. The degree of curl is a value determined in the following manner.

Curl Degree in Lateral Direction

A test piece cut out from the film in dimensions of a width of 35 mm and a length of 2 mm is subjected to humidity conditioning under the condition of 23° C. and 20% RH for one day. Then, a radius of curvature of the curl in the sample in a lateral direction is determined in terms of meter, and the curl degree is shown by an inverse number thereof. The unit is $m^{-1}$.

A method for providing the film with curl in a lateral direction shall not specifically be restricted and includes, for example, a method in which polyesters having different copolymerizable components and principal structural components are laminated, a method in which the same or different polyesters having different intrinsic viscosities are laminated, a method in which a three layer structure is formed and the thicknesses of both outer layers are changed and a method in which a stretching condition and a heat fixing condition on an outside and the inside are varied to provide distributions in the molecular orientation and the crystallinity in a thickness direction of the film. A method in which chemical treatment with resorcinol or the like is carried out is included as well. Further, it is a matter of course that curl can be given by suitably combining these methods or using these methods in a layer structure of four or more layers.

Among them, preferred because of easiness to control the degree of curl is a method in which polyesters having the same principal structural component and different copolymerizable components are laminated with a two layer structure or a method in which employed is a three layer structure in which polyesters having the same principal structural component and different copolymerizable components in a central layer and both outer layers are laminated and the thicknesses of both outer layers are varied. When the thicknesses of both outer layers are varied for this purpose, it is preferred in terms of production of the film to set up $1.1 \leqq d_1/d_2 \leqq 10$, wherein $d_1$ and $d_2$ are the thicknesses of both outer layers, respectively.

The film which does not fall in the range described above may have marked difficulty in stretching in a certain case.

The biaxially stretched polyester film of the present invention has preferably a haze of 3% or less, more preferably 1% or less. If the haze is larger than 3%, an image printed on a photographic paper is blurred to become indistinct. The haze described above is measured according to ASTM-D1003-52.

The biaxially stretched polyester film of the present invention has preferably a Tg of 60° C. or higher, more preferably 70° C. or higher. Tg is determined as an average value calculated from a temperature at which a base line measured by means of a differential scanning calorimeter starts to deviate and a temperature which returns again to the base line. The Tg of not smaller than this value prevents the film at a drying step in a development processing machine from being deformed to provide a light-sensitive material having small roll set curl after development processing.

Next, a production process for the polyester film of the present invention shall be explained.

Preparation of an unstretched sheet and uniaxial stretching of the sheet in a longitudinal direction can be carried out by conventionally known methods. For example, polyester of a raw material is molded into pellets, which are dried by hot air or vacuum and then mold-extruded from a T die in the form of a sheet, and the sheet is adhered closely on a cooling drum by an electrostatic applying method to be cooled and solidified, whereby an unstretched sheet is obtained. Then, the unstretched sheet thus obtained is heated in a range of from a glass transition temperature (Tg) of the polyester to Tg+100° C. through plural rolls and/or a heating device such as an infrared heater to carry out single stage or multistage longitudinal stretching. The stretching magnification falls usually in a range of 2.5 times to 6 times, which has to be a range in which subsequent lateral stretching can be carried out. When the sheet is of a multilayer structure, the stretching temperature is set up preferably based on the highest Tg among the Tg's of polyesters in the respective layers.

In this case, conventionally known methods may be employed as well when the polyesters are laminated. Included are, for example, a co-extrusion method carried out by means of plural extruding machines and a feed block type die or a multimanifold type die, an extrusion-laminating method in which other resins forming a laminate are melt-extruded from an extruding machine on a single layer film or a laminated layer film to be cooled and solidified on a cooling drum and a dry laminate method in which a single layer film or a laminated film constituting a laminate is laminated, if necessary, via an anchor agent and an adhesive. Among them, the co-extrusion method having less production steps and providing the good adhesive property between the respective layers is preferred.

Next, the polyester film obtained in the manner described above which has been uniaxially stretched in a longitudinal direction is laterally stretched preferably in a temperature range of Tg to Tm−20° C. and then thermally fixed. Usually, the lateral stretching magnification is preferably 3 to 6 times, and a ratio of the longitudinal to lateral stretching magnification is suitably controlled after measuring the physical properties of the resulting biaxially stretched film so that the preferred physical properties are obtained.

The ratio may be varied according to use purpose. In this case, if the film is laterally stretched in a stretching area divided into two or more parts while elevating the temperature in order in a temperature difference falling in a range of 1 to 50° C., a distribution of the physical properties in a lateral direction can preferably be reduced. Further, after laterally stretched, the film is maintained in a range of the final lateral stretching temperature or lower to not lower than Tg−40° C. for 0.01 to 5 minutes, whereby a distribution of the physical properties in the lateral direction can preferably be reduced furthermore.

Thermal fixation is carried out preferably in a temperature range of a higher temperature than the final lateral stretching temperature to not higher than Tm−20° C. Usually, the thermal fixation is carried out preferably for 0.5 to 300 seconds.

In this case, the themal fixation is preferably carried out in an area divided into two or more parts while elevating the temperature in order in a temperature difference falling in a range of 1 to 100° C.

Usually, the film thermally fixed is cooled down to Tg or lower, and clip-holding parts at both ends of the film are cut, and the film is wound in the form of a roll. In this case, relaxation treatment of 0.1 to 10% is preferably carried out in a temperature range of the final thermal fixing temperature or lower to Tg or higher in a lateral direction and/or a longitudinal direction. Cooling is carried out gradually at a cooling speed of 100° C. or less per second from the final thermal fixing temperature up to Tg. A means for cooling and relaxation treatment shall not specifically be restricted and may be conventionally known means. However, it is preferred in terms of improvement in the dimensional stability of the film to carry out these treatments while cooling in order in plural temperature regions. The cooling rate is a value determined from $(T_1-Tg)/t$, wherein $T_1$ is the final thermal fixing temperature, and t is the time spent until the film reaches Tg from the final thermal fixing temperature.

More optimum conditions of these thermal fixing conditions and cooling and relaxation treatment conditions are varied depending on polyesters forming the film and therefore can be settled by measuring the physical properties of the resulting biaxially stretched film and suitably controlling them so that the preferred physical properties are provided.

Further, in producing the film described above, functional layers such as an antistatic layer, a sliding layer, an adhesive layer and a barrier layer may be provided before and/or after stretching.

In this case, various surface treatments such as corona discharge treatment and chemical treatment can be carried out if necessary. Further, stretching used for conventionally known stretched films, such as multistage longitudinal stretching, longitudinal restretching, longitudinal and lateral restretching and lateral and longitudinal stretching can be carried out as well for the purpose of enhancing the strength.

It is a matter of course that the cut clip-holding parts at both ends of the film can be reused as a raw material for a film of the same kind or a raw material for a film of a different kind after subjected to pulverizing treatment or, if necessary, after pelletizing treatment and treatments such as depolymerization/repolymerization.

The biaxially stretched polyester film thus obtained is still liable to have roll set curl, and therefore it is preferable to further subject the biaxially stretched polyester film to heat treatment at a temperature of a Tg thereof or lower to not lower than Tg−30° C. A reduction effect of roll set curl can be obtained at the higher treating temperature for shorter time, but crinkles, pressing and folding of the film are liable to occur at too high temperature in a certain case.

The long treating time is required when the treating temperature is low, and if it is too low, a satisfactory reduction effect of roll set curl can not be obtained. The treating time shall not specifically be restricted. The reduction effect of roll set curl is observed at 0.1 hour or longer, and the longer the time provides the higher effect. Accordingly, it can suitably be set up so that the required effect can be obtained, but if it is too long, the productivity is inferior, and therefore the time of up to 1500 hours is usually realistic.

When carrying out the heat treatment, adhesion between the films is preferably prevented by subjecting the edge and central part of the film to embossing finish partially or over the whole length, carrying out processing to fold the end part, inserting other inclusions and increasing partially the thickness of the film, etc.

Among them, a method in which embossing finish is carried out is preferred since it is the simplest and the most sure. It is a matter of course that these methods may be combined. For this purpose, processing is preferably carried out usually in embossing finish so that irregularities of 10 to 100 μm can be formed. A position which is subjected to the embossing finish may be only the central part of the film or only both ends thereof or both may be combined. The embossing finish is carried out preferably at a space of 50 cm to 2 m in a lateral direction of the film.

When carrying out the heat treatment, a core used and a winding core shall not specifically be restricted but are preferably of a material and a structure which is provided with strength causing no deflection when the film is wound and which stands a heat treatment temperature. The smoother the surface of the core, the better, and the surface roughness (Rmax) is preferably 2.0 μm or less.

Examples thereof include resin rolls, fiber-reinforced resin rolls, metal rolls and ceramic coating rolls.

Too small core diameter is liable to produce crinkles at the core part, and therefore the diameter is preferably large to some extent. Usually, it is preferably 75 mm or more, more preferably 200 mm or more. The roll of the wound film has preferably a roll diameter which is small to some extent since too large diameter makes it difficult to carry out uniform processing. Usually, it is preferably 1000 mm or less, more preferably 850 mm or less. The width of the film roll shall not specifically be restricted but is preferably wider in terms of productivity. The width of 150 mm to 3500 mm inclusive is usual and preferred.

Further, there may be carried out flatness-improving treatment in which the film is carried while heating on a heating roller to be flattened. The flatness-improving treatment may be carried out at any stage before providing a photographic emulsion layer but as a matter of course, it is carried out preferably until immediately before providing a layer on which influence is most liable to be exerted among the respective layers. Usually, influence is liable to be exerted in many cases on a subbing layer and a back layer having small layer thicknesses rather than a photographic emulsion layer having a relatively large layer thickness, and therefore it is carried out preferably until before providing the back layer.

The surface temperature of the heating roller is preferably not higher than a temperature being higher by 50° C. than the glass transition temperature of the biaxially stretched polyester film and not lower than a temperature being lower by 20° C. than the above glass transition temperature, more preferably not higher than a temperature being higher by 20° C. than the above glass transition temperature and not lower than a temperature being lower by 10° C. than the above glass transition temperature. Uneven coating in the subbing layer and the back layer is removed by allowing the surface temperature of the heating roller to fall in this temperature range, and the photographic support which is less liable to get into roll set curl of the film is obtained.

In the present invention, the photographic support can be provided a subbing layer on the surface of the film. The material capable of being used for the subbing layer shall not specifically be restricted and includes, for example, polyethyleneimine, polyester, polystyrene, polyurethane, epoxy resins, grafted gelatin, nitrocellulose and so on and mixtures thereof as well as copolymers prepared by using vinyl chloride, vinylidene chloride, butadiene, methacrylic acid, acrylic acid, itaconic acid and maleic anhydride as starting raw materials. Allowed to be contained in these subbing layers is at least one of various additives such as surfactants, antistatic agents, antihalation agents, crossover cutting agents, color dyes, pigments, thickeners, coating aids, anti-fogging agents, antioxidants, UV absorbers, UV stabilizers, etching processing agents, magnetic powder and matting agents.

A method for providing the subbing layer shall not specifically be restricted, and conventionally known various methods can be used. Included is, for example a method in which a solution or a dispersion prepared by dissolving or dispersing the materials described above in a suitable solvent is prepared and applied on the surface of the film by means of an air knife coater, a dip coater, a curtain coater, etc., a wire bar coater, a gravure coater or an extrusion coater, followed by drying. In this case, allowed to be used if necessary are a method in which carried out is surface activation treatment such as corona discharge, UV-ray treatment, glow discharge treatment, plasma treatment and flame treatment and a method in which carried out is etching treatment such as resorcinol treatment, phenols treatment, alkali treatment, amine treatment and trichloroacetic acid treatment. It is a matter of course that these treatments may be combined. Among them, the corona discharge treatment is preferably used. The coating solution is preferably an aqueous dispersion or an aqueous solution from a working-environmental point of view.

The subbing layer may be formed by a single layer or two or more layers. Further, allowed to be included therein are an antistatic layer, a sliding layer, a barrier layer, an antihalation layer, a crossover cutting layer, a UV absorbing layer and a magnetic recording layer, etc.

The film on which the subbing layer is applied in the manner described above is cooled down to a room temperature, wound and stored during until it is sent to a subsequent step. In this case, roll set curl caused during storage can be prevented by controlling a moisture content of the film to 0.2% or less, and therefore it is preferred.

Next, a method for preparing a photographic material shall be explained.

The photographic material means a material to form and record an image which can visually be distinguished by means of light energy such as light, radial rays and corpuscular rays and a material on which the image is recorded. A method for recording information by means of light energy includes a method in which information is recorded directly on a light-sensitive material and a method in which information is once converted into other energy and recorded. The former includes light-sensitive materials using electrophotography, diazo, photo polymer, free radical and photochromic as well as a silver halide light-sensitive material, and the latter includes recording materials using electron, static charge, electrolysis, heat, pressure and ink jet.

In the present invention, any type of a photographic material may be formed, and a photographic material using silver halide shall be explained below.

In a silver halide light-sensitive material, a photographic emulsion layer is provided at least on one side of the photographic support of the present invention, and the photographic emulsion layer can be formed by applying a silver halide emulsion. The photographic emulsion layer can be provided on one surface or both surfaces of the photographic support. At least one photographic emulsion layer can be provided on the respective layers. A silver halide emulsion can be applied on the photographic support directly or via another layer, for example, a hydrophilic colloid layer containing no silver halide emulsion. Further, the silver halide emulsion layer may be provided dividing into respective silver halide emulsion layers having different sensitivities, for example, high sensitivity and low sensitivity. In this case, an intermediate layer may be provided between the respective silver halide emulsion layers. Further, non-light-sensitive layers such as a hydrophilic colloid layer, a protective layer, an antihalation layer, a backing layer and a masking layer may be provided on the silver halide emulsion layer or in an optional place between the intermediate layer or the silver halide emulsion layer and the photographic support.

The silver halide emulsion used in the present invention can be prepared by methods described in, for example, "1. Emulsion Preparation and Types" in Research Disclosure (hereinafter abbreviated as RD) No. 17643, pp. 22 to 23 (December 1979), RD No. 18716, pp. 648, P. Glkides, [Chemie et Phyzique Photographique], Paul Montel, 1967, G. F. Daffin, [Photographic Emulsion Chemistry], Focal Press, 1966, and V. L. Zelikman et al, [Making and Coating Photographic Emulsion], Focal Press, 1964.

Monodispersed emulsions described in U.S. Pat. Nos. 3,574,628 and 3,665,394 and British Patent 1,413,748, etc., are preferred as the silver halide emulsion used in the present invention.

The silver halide emulsion used in the present invention can be subjected to physical ripening, chemical ripening and spectral sensitization. Additives used in such steps are described in RD No. 17643, RD No. 18716 and RD No. 308119 (hereinafter abbreviated as RD17643, RD18716 and RD308119 respectively). Description parts thereof shall be shown below.

| Item | RD308119 | RD17643 | RD18716 |
|---|---|---|---|
| Chemical sensitizer | pp. 996 III-item A | pp. 23 | pp. 648 |
| Spectral sensitizer | pp. 996 IV-item A, B, C, D, I, J | pp. 23 to 24 | pp. 648 to 649 |
| Supersensitizer | pp. 996 IV-item A to E, J | pp. 23 to 24 | pp. 648 to 649 |
| Antifogging agent | pp. 998 VI | pp. 24 to 25 | pp. 649 |
| Stabilizer | pp. 998 VI | pp. 24 to 25 | pp. 649 |

When the light-sensitive material used in the present invention is a color photographic light-sensitive material, photographic additives capable of being used are described in above RD. Description parts related thereto shall be shown below.

| Item | RD308119 | RD17643 | RD18716 |
|---|---|---|---|
| Color turbidity preventive | pp. 1002 VII-item I | pp. 25 | pp. 650 |
| Dye image Stabilizer | pp. 1001 VII-item J | pp. 25 | |
| Whitening agent | pp. 998 V | pp. 24 | |
| UV absorber | pp. 1003 IIIV-C, XIII-item C | pp. 25 to 26 | |
| Light absorber | pp. 1003 VIII | pp. 25 to 26 | |
| Light disperser | pp. 1003 VIII | | |
| Filter dye | pp. 1003 VIII | pp. 25 to 26 | |
| Binder | pp. 1003 IX | pp. 26 | pp. 651 |
| Antistatic agent | pp. 1006 XIII | pp. 27 | pp. 650 |
| Hardening agent | pp. 1004 X | pp. 26 | pp. 651 |
| Plasticizer | pp. 1006 XII | pp. 27 | pp. 650 |
| Lubricant | pp. 1006 XII | pp. 27 | pp. 650 |
| Activator/coating aid | pp. 1005 XI | pp. 26 to 27 | pp. 650 |
| Matting agent | pp. 1007 XVI | | |
| Developer (contained in the light-sensitive material) | pp. 1011 XX-item B | | |

When the light-sensitive material used in the present invention is a color photographic light-sensitive material, various couplers can be used. Specific examples thereof are described in RD17643 and RD308119 described below.

Description parts related thereto shall be shown below.

| Item | RD308119 | RD17643 |
|---|---|---|
| Yellow coupler | pp. 1001 VII-item D | pp. 25 VII-items C to G |
| Magenta coupler | pp. 1001 VII-item D | pp. 25 VII-items C to G |
| Cyan coupler | pp. 1001 VII-item D | pp. 25 VII-items C to G |
| Colored coupler | pp. 1002 VII-item G | pp. 25 VII-item G |
| DIR coupler | pp. 1001 VII-item F | pp. 25 VII-item F |
| BAR coupler | pp. 1002 VII-item F | |
| Other useful residue-releasing coupler | pp. 1002 VII-item F | |
| Alkali-soluble coupler | pp. 1001 VII-item E | |

These additives can be added to the photographic light-sensitive layer by dispersing methods described in pp. 1007 item XIV of RD308119.

When the light-sensitive material used in the present invention is a color photographic light-sensitive material, auxiliary layers such as a filter layer and an intermediate layer described in item VII-K of RD308119 described above can be provided.

When the color photographic light-sensitive material described above is constituted, various layer structures such as a forward layer, a reverse layer and unit structure described in item VII-K of RD308119 described above can be employed.

In order to subject the photographic light-sensitive material used in the present invention to development processing, there can be used conventionally known developers described in, for example, T. H. James, The Theory of The Photographic Process Fourth Edition, pp. 291 to 334 and Journal of the American Chemical Society, vol. 73, No. 3, pp. 100 (1951). Further, the color photographic light-sensitive material described above can be subjected to development processing by conventional methods described in pp. 28 to 29 of RD17643, pp. 615 of RD18716 and XIX of RD308119 each described above.

EXAMPLES

The present invention shall specifically be explained below with reference to examples but the present invention shall not be restricted thereto.

In the following examples, glass transition temperature, intrinsic viscosity, elastic modulus, rupture strength, roll set curl values and the respective evaluation ranks of coating fault, flatness and cutting property were determined according to the following methods.

(1) Glass transition temperature Tg

A film or a pellet (10 mg) is molten at 300° C. in nitrogen flow of 300 ml per minute and immediately quenched in liquid nitrogen. This quenched sample is set in a differential scanning type calorimeter (model DSC8230 manufactured by Rigaku Denki Co., Ltd.) and heated at a heating rate of 10° C. per minute in nitrogen flow of 100 ml per minute to determine Tg. Tg is determined as an average value calculated from a temperature at which a base line starts to deviate and a temperature which returns again to the base line. A measurement-starting temperature is set to a temperature which is lower by 100° C. or more than Tg to be measure.

(2) Intrinsic viscosity

A film or a pellet is dissolved in a mixed solvent (weight ratio 60/40) of phenol and 1,1,2,2-tetrachloroethane to prepare solutions having concentrations of 0.2 g/dl, 0.6 g/dl and 1.0 g/dl, and the specific viscosities (ηsp) in the respective concentrations (C) are determined at 20° C. by means of a Ubbelohde type viscometer. Then, ηsp/C is plotted against C, and the resulting straight line is extrapolated to a concentration of zero to determine:

$$\text{intrinsic viscosity } [\eta] = \lim_{C \to 0} (\eta sp/C)$$

The unit is shown by dl/g.

(3) Elastic modulus and rupture strength

The film is cut to a size of width 10 mm and length 200 mm and subjected to humidity conditioning under the condition of 23° C. and 55% RH for 12 hours, and then a tensile test is carried out by means of Tensilon (RTA-100) manufactured by Orientech Co., Ltd. at a space of 100 m between the chucks and a drawing rate of 100 mm/minute to determine the elastic modulus and the rupture strength.

(4) Roll set curl

The light-sensitive material having a size of width 35 mm and length 1200 mm is subjected to humidity conditioning under the condition of 23° C. and 55% RH for one day and then wound on a core having a diameter of 7 mm with the photographic light-sensitive layer side being turned inside and fixed so that it does not rebound. Then, this film is loaded in a polyethylene-made patrone case and subjected to heat treatment under the condition of 50° C. and 20% RH for 4 hours. Further, it is left for cooling under the condition of 23° C. and 55% RH for one hour. Then, the film is released from the core and nipped with a clip with the end of the film far from the core being turned upward to be hung. In this state, it is further left for standing under the condition of 23° C. and 55% RH for one hour. Thereafter, the degree of the roll set curl at the lower end of the film is determined in terms of a reciprocal of the radius of curvature. The unit is $m^{-1}$.

The evaluation is classified into the following three grades. The rank Δ is no problem in terms of handling a photographic film, but the grade ○ or higher is preferred.

○: 110 $m^{-1}$ or less

Δ: more than 110 $m^{-1}$ to 130 $m^{-1}$

X: more than 130 $m^{-1}$ (5) Coating fault

The number of surface faults per $m^2$ of the film is visually evaluated and ranked according to the following criteria. Practicability in this ranking is determined based on the allowability of the quality as a photographic light-sensitive material, and the rank of ○ or higher is required.

Rank Number of surface faults

| Rank | Number of surface faults |
|---|---|
| ○ | 0 |
| Δ | 1 to 3 |
| × | 4 or more |

(5) Flatness

The film is subjected to humidity conditioning under the condition of 23° C. and 55% RH for 12 hours and then spread on a flat disc to visually evaluate the degree of waving thereof, which is ranked according to the following criteria. Practicability in this ranking is determined based on the allowability of the quality as a light-sensitive material, and the rank of ○ or higher is required.

Rank Degree of waving

| Rank | Degree of waving |
|---|---|
| ○ | good |
| Δ | careful observation reveals waving |
| × | large waving observed |

Cutting property

A wide sample obtained after providing a light-sensitive layer on the polyester film support is slit-cut to with a width of 35 mm at a carrying rate of 100 m/minute, and perforations are punched at the same time. Then, it is cut to a light-sensitive material having a length of 120 cm.

Twenty samples thus prepared are wound on cores having a diameter of 8 mm and then released one day later to be subjected to conventional development processing used in the market.

Peeling of the silver halide emulsion layer in the slit part and the perforation part of the sample after the development processing is observed to be visually evaluated according to the following three criteria. The grade of ○ is required in terms of practicability.

○: no peeling in both slit part and perforation part

Δ: slight peeling observed in either of slit part and perforation part

X: peeling observed in either of slit part and perforation part

Example 1

Polyester resins were prepared in the following manners.

(PET-A)

There was added 0.05 part by weight of magnesium acetate hydrate as a transesterification catalyst to 100 parts by weight of dimethyl terephthalate and 65 parts by weight of ethylene glycol to carry out transesterification according to a conventional method. There was added 0.05 part by weight of antimony trioxide and 0.03 part by weight of trimethyl phosphate to the resulting product. Then, the temperature was gradually elevated, and the pressure was reduced to carry out polymerization at 280° C. and 0.5 mmHg, whereby polyethylene terephthalate having an intrinsic viscosity of 0.50 was obtained.

(PET-B)

Polyethylene terephthalate having an intrinsic viscosity of 0.34 was obtained in the same manner as in PET-A.

(PET-C)

PET-A was pre-crystallized at 100° C. for 2 hours and then subjected to solid phase polymerization at 180° C. under a stream of nitrogen to obtain polyethylene terephthalate having an intrinsic viscosity of 0.87.

(PEN-A)

There was added 0.05 part by weight of manganese acetate tetrahydrate as a transesterification catalyst to 122 parts by weight of 2,6-dimethyl naphthalate and 69 parts by weight of ethylene glycol to carry out transesterification according to a conventional method. There was added 0.04 part by weight of antimony trioxide and 0.03 part by weight of trimethyl phosphate to the resulting product. Then, the temperature was gradually elevated, and the pressure was reduced to carry out polymerization at 290° C. and 0.5 mmHg, whereby polyethylene 2,6-naphthalate having an intrinsic viscosity of 0.58 was obtained.

(PEN-B)

PEN-A was pre-crystallized at 130° C. for 2 hours and then subjected to solid phase polymerization at 215° C. under a stream of nitrogen to obtain polyethylene 2,6-naphthalate having an intrinsic viscosity of 0.80.

(PEN-C)

Polyethylene 2,6-naphthalate having an intrinsic viscosity of 0.40 was obtained in the same manner as in PEN-A.

(PEN-D)

There was added 100 parts by weight of dimethyl 2,6-naphthalenedicarboxylate, 56 parts by weight of ethylene glycol and 4.1 parts by weight (5 mole %) of 1,4-butanediol, and magnesium acetate hydrate (0.1 part by weight) as a transesterification catalyst was added to carry out transesterification according to a conventional method. Antimony trioxide (0.04 part by weight) and trimethyl phosphate (0.1 part by weight) were added to the resulting product. Then, the temperature was gradually elevated, and the pressure was reduced to carry out polymerization at 285° C. and 0.5 mmHg, whereby copolymerized polyester in which polyethylene 2,6-naphthalenedicarboxylate having an intrinsic viscosity of 0.40 was a principal component was obtained.

Dyes Mackrox.Green G and Mackrox.Red 5B manufactured by Bayer Co., Ltd. were added to the respective polyesters thus prepared in a ratio 1:1 (weight ratio) to prepare master pellets having a dye concentration of 2000 ppm by means of an extruding machine.

The respective polyesters thus obtained were used to prepare biaxially stretched polyester films of Comparative Examples 1 to 3 and Present Inventions 1 to 6 in the following manners.

Comparative Example 1

PET-A and the master pellets of PET-A were blended to a proportion of 9:1 in term of weight ratio by means of a tumbler type mixer. Then, after drying by vacuum at 150° C. for 8 hours, the resin was melt-extruded from a T die at 285° C. in the form of a film and adhered closely on a cooling drum of 30° C. while applying a static charge to be cooled and solidified, whereby an unstretched film was obtained. This unstretched sheet was stretched by 3.3 times in a longitudinal direction at 80° C. by means of a roll type longitudinal stretching machine. The resulting uniaxially stretched film was stretched by 50% in terms of the whole lateral stretching magnification at 90° C. in the first stretching zone by means of a tenter type lateral stretching machine and further stretched to 3.3 times in terms of the whole lateral stretching magnification at 100° C. in the second stretching zone. Then, the film was subjected to pre-heat treatment at 70° C. for 2 seconds and further thermally fixed at 50° C. for 5 seconds in the first fixing zone, followed by being thermally fixed at 220° C. for 15 seconds in the second fixing zone. Subsequently, the film was cooled down to a room temperature in 60 seconds while subjecting to relaxation treatment of 5% in a lateral direction, and the film was released from a clip and wound to obtain the biaxially stretched film having a thickness of 90 $\mu$m.

Comparative Example 2

A biaxially stretched film having a thickness of 90 $\mu$m was obtained in the same manner as in Comparative Example 1, except that PEN-A and the master pellets of PEN-A were substituted for PET-A and the master pellets of PET-A and changed were the melt-extruding temperature to 300° C., the cooling drum temperature to 50° C., the longitudinal stretching temperature to 135° C., the first lateral stretching zone temperature to 145° C., the second lateral stretching zone temperature to 155° C., the pre-heat treating temperature to 100° C., the first fixing zone temperature to 200° C. and the second fixing zone temperature to 230° C.

Comparative Example 3

PET-A and the master pellets of PET-A, and PEN-A and the master pellets of PEN-A were blended by means of a tumbler type mixer so that the ratio of the total weight of PET-A and the master pellets of PET-A to the total weight of PEN-A and the master pellets of PEN-A were controlled to the blend ratio shown in Example 1. In this case, the resins and the master pellets were blended so that the ratio of the resins to the master pellets was 9:1 in terms of a weight ratio based on the total weight of the respective polyesters blended as was the case with Comparative Example 1. A biaxially stretched film having a thickness of 90 μm was obtained in the same manner as in Comparative Example 1, except that in the film-forming conditions, changed were the melt-extruding temperature to 295° C., the cooling drum temperature to 45° C., the longitudinal stretching temperature to 110° C., the first lateral stretching zone temperature to 125° C., the second lateral stretching zone temperature to 135° C., the pre-heat treating temperature to 85° C., the first fixing zone temperature to 180° C. and the second fixing zone temperature to 225° C.

Present Invention 1

The resins were blended by the same method as in Comparative Example 3, except that PET-B and PET-C were substituted for PET-A and PEN-A. In the film-forming conditions, the same temperatures as in Comparative Example 1 were used.

Present Invention 2

The resins were blended by the same method as in Comparative Example 3, except that PET-B was substituted for PET-A. In the film-forming conditions, the same temperatures as in Comparative Example 3 were used.

Present Invention 3

The resins were blended to form a film by the same method as in Comparative Example 3, except that the ratio of PEN-B to PEN-C was changed to the value shown in Example 1.

Present Invention 4

The resins were blended to form a film by the same method as in Comparative Example 3, except that the ratio of PEN-B to PEN-C was changed to the value shown in Example 1.

Present Invention 5

The resins were blended by the same method as in Comparative Example 3, except that PEN-B was substituted for PET-A. In the film-forming conditions, the same temperatures as in Comparative Example 2 were used.

Present Invention 6

The resins were blended by the same method as in Comparative Example 3, except that PEN-B and PEN-D were substituted for PET-A and PEN-A. In the film-forming conditions, the same temperatures as in Comparative Example 2 were used.

The films thus obtained were slit to a width of 1 m and subjected to embossing finish of a height of 15 μm and a width of 10 mm while pressing an embossing ring to both end parts thereof. Then, they were wound on SUS-made cores having a diameter of 200 mm and a surface roughness (Rmax) of 0.8 μm while varying a tensile force so that an initial tensile force of 25 kgf and a final tensile force of 20 kgf could be achieved.

Next, the films which remained in the state that they were wound on the cores were subjected to heat treatment for reducing roll set curl at the respective annealing temperatures (Atemp) shown in Example 1 for 24 hours. In the heat treatment, the temperature was elevated in 24 hours, and after carrying out the treatment at a prescribed temperature for prescribed time, the films were cooled down to a room temperature in further 24 hours.

Then, a subbing layer was provided on the film thus obtained in the following manner.

A face of the film on which a photographic emulsion layer was to be provided was subjected to corona discharge treatment of 8 W/(m$^2$·min), and the following coating solution A-1 was applied thereon under the environment of 25° C. and 50% RH by means of a roll fit coating pan and an air knife and dried at a drying temperature of 115° C. for one minute to form a layer having a thickness of 0.8 μm after drying.

| <Coating solution A-1> | |
|---|---|
| Copolymerized latex solution (solid content: 30%) of butyl acrylate (30% by weight), t-butyl acrylate (20% by weight), styrene (25% by weight) and 2-hydroxyethyl acrylate (25% by weight) | 270 g |
| Compound (UL-1) | 0.6 g |
| Hexamethylene-1,6-bis(ethyleneurea) | 0.8 g |
| Water added for making up to | 1000 ml |

Further, the following coating solution A-2 was applied on the A-1 coated face in the same manner to form a layer having a thickness of 0.1 μm after drying.

| <Coating solution A-2> | |
|---|---|
| Gelatin | 10 g |
| Compound (UL-1) | 0.2 g |
| Compound (UL-2) | 0.2 g |
| Compound (UL-3) | 0.1 g |
| Silica particles (average particle diameter: 3 μm) | 0.1 g |
| Water added for making up to | 1000 ml |

The following solution B-1 was applied on the other face of the support so that the dry film thickness was 0.6 μm to form a conductive layer B-1.

| <Coating solution B-1> | |
|---|---|
| Aqueous dispersion (solid content: 30% by weight) of LX-1 (shown below) | 270 g |
| Compound (UL-1) | 0.6 g |
| Dispersion A (shown below) | 560 g |
| Water added for making up to | 1000 ml |

-continued

| <LX-1> | |
|---|---|
| 5-Sulfoisophthalic acid | 5 mole % |
| Isophthalic acid | 15 mole % |
| Tererphthalic acid | 30 mole % |
| Ethylene glycol | 25 mole % |
| Diethylene glycol (average particle diameter: 60 nm) | 25 mole % |

Dispersion A

A mixed solution of powder (400 g) of antimony-doped tin oxide SN-100P manufactured by Ishiwara Sangyo Co., Ltd. and water (600 g) was adjusted to pH 7.0 and then dispersed by means of a stirrer and a sand mill to prepare a dispersion A.

Further, the conductive layer B-1 was subjected to corona discharge treatment of 8 W/($m^2$·min), and the following coating solution MC-1 was applied thereon so that the dry film thickness was 1 μm.

| <MC-1> | |
|---|---|
| Nitrocellulose | 35% by weight |
| Polyurethane resin | 35% by weight |
| Lauric acid | 1% by weight |
| Oleic acid | 1% by weight |
| Butyl stearate | 1% by weight |
| Cyclohexanone | 75% by weight |
| Methyl ethyl ketone | 150% by weight |
| Toluene | 150% by weight |
| Co-deposited γ-$Fe_2O_3$ (major axis: 0.2 μm, minor axis: 0.02 μm, Hc = 650 Oe) | 5% by weight |

Further, the following coating solution OC-2 was applied on MC-1 to 10 ml/$m^2$.

| <OC-2> | |
|---|---|
| Carnauba wax | 1 g |
| Toluene | 700 ml |
| Methyl ethyl ketone | 300 ml |

When the polyester film had anti-curl, a back layer was provided on the concave face side under the environment of 23° C. and 55% RH.

Coating of photographic light-sensitive layer

The surface of the A layer of the film described above was subjected to corona discharge treatment of 25 W/($m^2$·min), and then the following photographic structural layers were formed in order, whereby a color photographic light-sensitive material was prepared.

Amounts in the following photographic structural layers are shown by amounts per $m^2$ unless otherwise described.

The amounts of silver halide and colloidal silver are shown in terms of values reduced to silver.

| <Photographic structural layers> | |
|---|---|
| First layer: antihalation layer (HC) | |
| Black colloidal layer | 0.15 g |
| UV-absorber (UV-1) | 0.20 g |

-continued

| <Photographic structural layers> | |
|---|---|
| Colored cyan coupler (CC-1) | 0.02 g |
| High boiling solvent (Oil-1) | 0.20 g |
| High boiling solvent (Oil-2) | 0.20 g |
| Gelatin | 1.6 g |
| Second layer: intermediate layer (IL-1) | |
| Gelatin | 1.3 g |
| Third layer: low sensitivity red-sensitive emulsion layer (R-L) | |
| Silver iodobromide emulsion (average grain diameter: 0.3 μm, average iodine content: 2.0 mole %) | 0.4 g |
| Silver iodobromide emulsion (average grain diameter: 0.4 μm, average iodine content: 8.0 mole %) | 0.3 g |
| Sensitizing dye (S-1) | $3.2 \times 10^{-4}$ (mole/mole of silver) |
| Sensitizing dye (S-2) | $3.2 \times 10^{-4}$ (mole/mole of silver) |
| Sensitizing dye (S-3) | $0.2 \times 10^{-4}$ (mole/mole of silver) |
| Cyan coupler (C-1) | 0.50 g |
| Cyan coupler (C-2) | 0.13 g |
| Colored cyan coupler (CC-1) | 0.07 g |
| DIR compound (D-1) | 0.006 g |
| DIR compound (D-2) | 0.01 g |
| High boiling solvent (Oil-1) | 0.55 g |
| Gelatin | 1.0 g |
| Fourth layer: high sensitivity red-sensitive emulsion layer (R-H) | |
| Silver iodobromide emulsion (average grain diameter: 0.7 μm, average iodine content: 7.5 mole %) | 0.9 g |
| Sensitizing dye (S-1) | $1.7 \times 10^{-4}$ (mole/mole of silver) |
| Sensitizing dye (S-2) | $1.6 \times 10^{-4}$ (mole/mole of silver) |
| Sensitizing dye (S-3) | $0.1 \times 10^{-4}$ (mole/mole of silver) |
| Cyan coupler (C-2) | 0.23 g |
| Colored cyan coupler (CC-1) | 0.03 g |
| DIR compound (D-2) | 0.02 g |
| High boiling solvent (Oil-1) | 0.25 g |
| Gelatin | 1.0 g |
| Fifth layer: intermediate layer (IL-2) | |
| Gelatin | 0.8 g |
| Sixth layer: low sensitivity green-sensitive emulsion layer (G-L) | |
| Silver iodobromide emulsion (average grain diameter: 0.4 μm, average iodine content: 8.0 mole %) | 0.6 g |
| Silver iodobromide emulsion (average grain diameter: 0.3 μm, average iodine content: 2.0 mole %) | 0.2 g |
| Sensitizing dye (S-4) | $6.7 \times 10^{-4}$ (mole/mole of silver) |
| Sensitizing dye (S-5) | $0.8 \times 10^{-4}$ (mole/mole of silver) |
| Magenta coupler (M-1) | 0.17 g |
| Magenta coupler (M-2) | 0.43 g |
| Colored magenta coupler (CM-1) | 0.10 g |
| DIR compound (D-3) | 0.02 g |
| High boiling solvent (Oil-2) | 0.7 g |
| Gelatin | 1.0 g |
| Seventh layer: high sensitivity green-sensitive emulsion layer (G-H) | |
| Silver iodobromide emulsion (average grain diameter: 0.7 μm, average iodine content: 7.5 mole %) | 0.9 g |
| Sensitizing dye (S-6) | $1.1 \times 10^{-4}$ (mole/mole of silver) |
| Sensitizing dye (S-7) | $2.0 \times 10^{-4}$ |

-continued

| <Photographic structural layers> | |
|---|---|
| | (mole/mole of silver) |
| Sensitizing dye (S-8) | $0.3 \times 10^{-4}$ (mole/mole of silver) |
| Magenta coupler (M-1) | 0.30 g |
| Magenta coupler (M-2) | 0.13 g |
| Colored magenta coupler (CM-1) | 0.04 g |
| DIR compound (D-3) | 0.004 g |
| High boiling solvent (Oil-2) | 0.35 g |
| Gelatin | 1.0 g |
| Eighth layer: yellow filter layer (YC) | |
| Yellow colloidal silver | 0.1 g |
| Additive (HS-1) | 0.07 g |
| Additive (HS-2) | 0.07 g |
| Additive (SC-1) | 0.12 g |
| High boiling solvent (Oil-2) | 0.15 g |
| Gelatin | 1.0 g |
| Ninth layer: low sensitivity blue-sensitive emulsion layer (B-L) | |
| Silver iodobromide emulsion (average grain diameter: 0.3 μm, average iodine content: 2.0 mole %) | 0.25 g |
| Silver iodobromide emulsion (average grain diameter: 0.4 μm, average iodine content: 8.0 mole %) | 0.25 g |
| Sensitizing dye (S-9) | $5.8 \times 10^{-4}$ (mole/mole of silver) |
| Yellow coupler (Y-1) | 0.6 g |
| Yellow coupler (Y-2) | 0.32 g |
| DIR compound (D-1) | 0.003 g |
| DIR compound (D-2) | 0.006 g |
| High boiling solvent (Oil-2) | 0.18 g |
| Gelatin | 1.3 g |
| Tenth layer: high sensitivity blue-sensitive emulsion layer (B-H) | |
| Silver iodobromide emulsion: (average grain diameter: 0.8 μm, average iodine content: 8.5 mole %) | 0.5 g |
| Sensitizing dye (S-10) | $3 \times 10^{-4}$ (mole/mole of silver) |
| Sensitizing dye (S-11) | $1.2 \times 10^{-4}$ (mole/mole of silver) |
| Yellow coupler (Y-1) | 0.18 g |
| Yellow coupler (Y-2) | 0.10 g |
| High boiling solvent (Oil-2) | 0.05 g |
| Gelatin | 1.0 g |
| Eleventh layer: first protective layer (PRO-1) | |
| Silver iodobromide (average grain diameter: 0.08 μm) | 0.3 g |
| UV absorber (UV-1) | 0.07 g |
| UV absorber (UV-2) | 0.10 g |
| Additive (HS-1) | 0.2 g |
| Additive (HS-2) | 0.1 g |
| High boiling solvent (Oil-1) | 0.07 g |
| High boiling solvent (Oil-3) | 0.07 g |
| Gelatin | 0.8 g |
| Twelfth layer: second protective layer (PRO-2) | |
| Compound A | 0.04 g |
| Compound B | 0.004 g |
| Polymethyl methacrylate (average grain diameter: 3 μm) | 0.02 g |
| Gelatin | 0.7 g |

Preparation of silver iodobromide emulsion

The silver iodobromide emulsion used for the tenth layer was prepared by the following method.

Monodispersed silver iodobromide grains (silver iodide content: 2 mole %) having an average grain diameter of 0.33 μm were used as seed crystals to prepare the silver iodobromide emulsion by a double jet method.

A solution <G-1> having the following composition was maintained at a temperature of 70° C., pAg 7.8 and pH 7.0, and a seed emulsion corresponding to 0.34 mole was added thereto while stirring well.

Formation of inner portion-high iodine content phase-core phase:

Then, a solution <H-1> having the following composition and a solution <S-1> having the following composition were added at an accelerated flow rate (flow rate at completion was 3.6 times as large as initial flow rate) in 86 minutes while maintaining a flow amount ratio of 1:1.

Formation of outer portion-low iodine content phase-shell phase:

Subsequently, <H-2> and <S-2> were added at a flow ratio of 1:1 and an accelerated flow rate (flow rate at completion was 5.2 times as large as initial flow rate) in 65 minutes while maintaining pAg 10.1 and pH 6.0.

pAg and pH were controlled using a potassium bromide solution and a 56% acetic acid aqueous solution during formation of the grains. After formation of the grains, the grains were subjected to water washing treatment by a conventional flocculation method and then dispersed again after adding gelatin, and pH and pAg were controlled to 5.8 and 8.0, respectively, at 40° C.

The resulting emulsion was a monodispersed emulsion containing octahedral silver iodobromide grains having an average grain diameter of 0.80 μm, a distribution width of 12.4% and a silver iodide content of 8.5 mole %.

| | |
|---|---|
| <G-1> | |
| Ossein gelatin | 100.0 g |
| 10 weight % ethanol solution of Compound-I shown below | 25.0 ml |
| 28% Aqueous ammonia | 440.0 ml |
| 56% Acetic acid aqueous solution | 660.0 ml |
| Water added to make up to | 5000.0 ml |
| (Compound-I: polyisopropyleneoxy.polyethyleneoxy.sodium disuccinate) | |
| <H-1> | |
| Ossein gelatin | 82.4 g |
| Potassium bromide | 151.6 g |
| Potassium iodide | 90.6 g |
| Water added to make up to | 1030.5 ml |
| <S-1> | |
| Silver nitrate | 309.2 g |
| 28% Aqueous ammonia | equivalent amount |
| Water added to make up to | 1030.5 ml |
| <H-2> | |
| Ossein gelatin | 302.1 g |
| Potassium bromide | 770.0 g |
| Potassium iodide | 33.2 g |
| Water added to make up to | 3776.8 ml |
| <S-2> | |
| Silver nitrate | 1133.0 g |
| 23% Aqueous ammonia | equivalent amount |
| Water added to make up to | 3776.8 ml |

Average grain diameters of seed crystals, temperatures, pAg, pH, flow rates, addition time and halide compositions of the silver iodobromide emulsions used in the emulsion layers other than the tenth layer were changed as well in the same manners to prepare the above respective emulsions having different average grain diameters and silver iodide contents.

All emulsions were core/shell type monodispersed emulsions having a distribution width of 20% or less. The respective emulsions were subjected to optimum chemical ripening in the presence of sodium thiosulfate, chloroauric acid and ammonium thiocyanate, and added were a sensitizing dye, 4-hydroxy-6-methyl-1,3,3a,7-tetrazaindene and 1-phenyl-5-mercaptotetrazole.

Further, the light-sensitive material described above contains compounds SU-1 and SU-2, a viscosity controlling agent, hardeners H-1 and H-2, a stabilizer ST-1, antifogging agents AF-1 and Af-2 (having weight average molecular weights of 10,000 and 1,100,000), dyes AI-1 and AI-2 and a compound DI-1 (9.4 mg/m$^2$).

The structures of the respective compounds used for forming the multilayer color photographic light-sensitive material described above are shown below.

UL-1

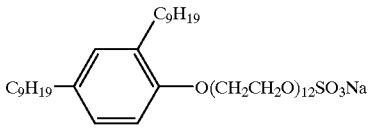

UL-2

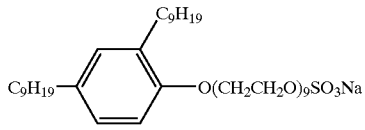

UL-3

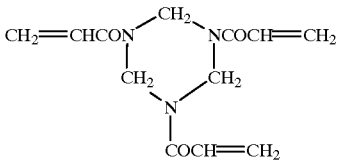

C-1

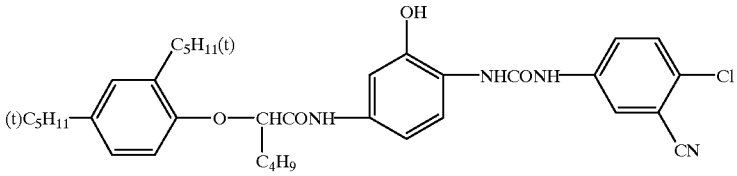

C-2

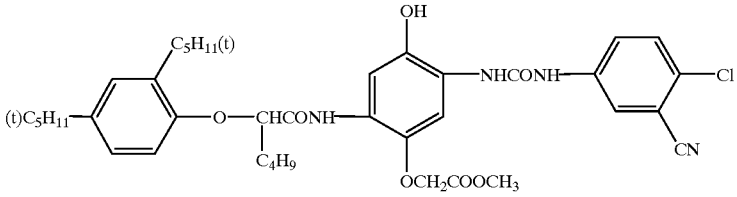

M-1

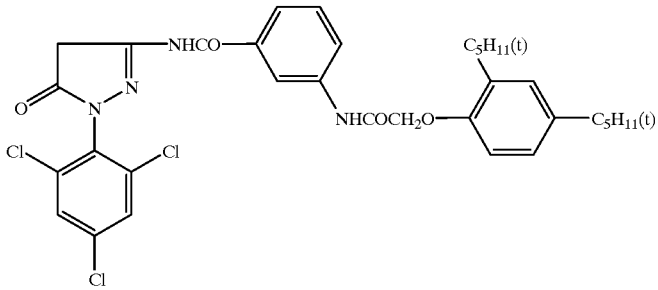

M-2

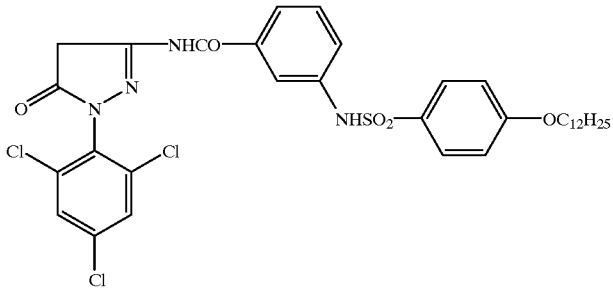

-continued
Y-1
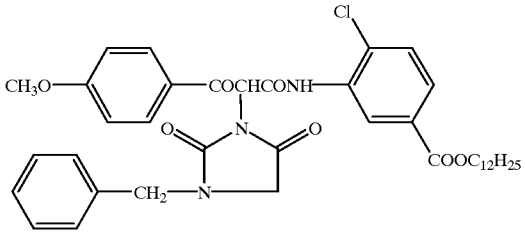
Y-2
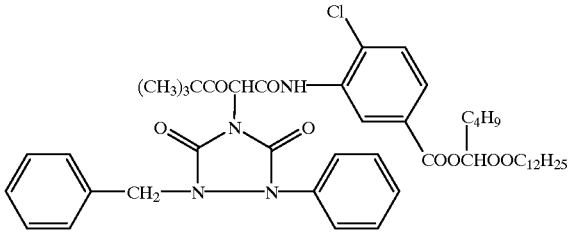
CC-1
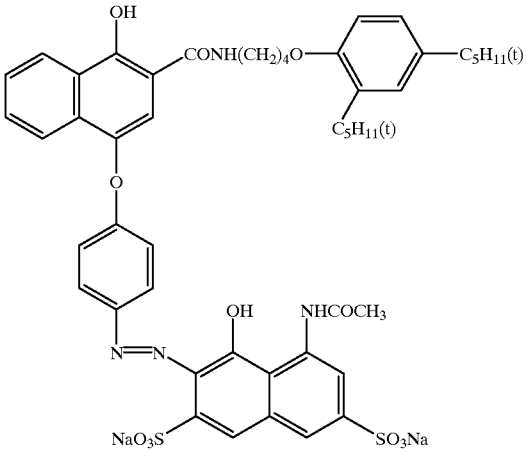
CM-1
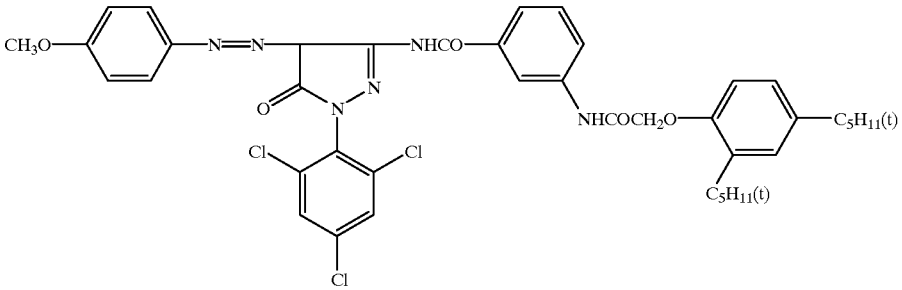

-continued
D-1
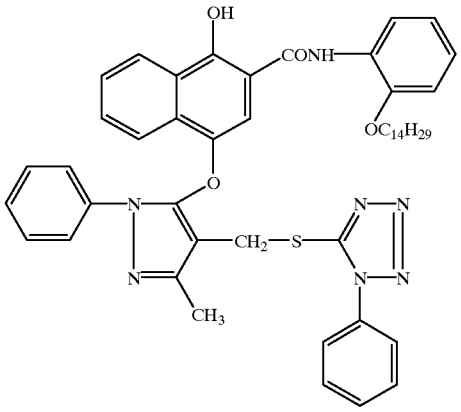
D-2
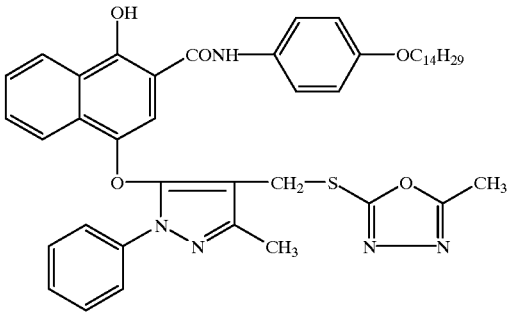
D-3
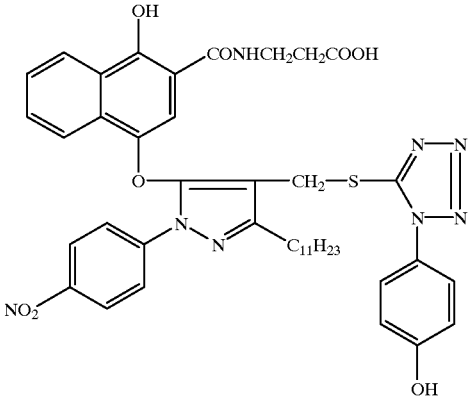
UV-1
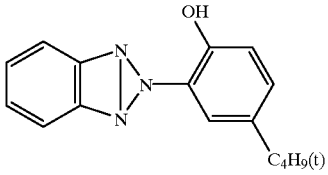
UV-2
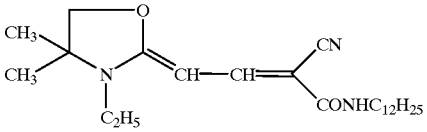
S-1
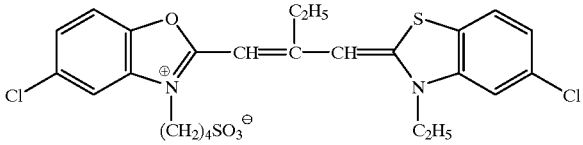
S-2
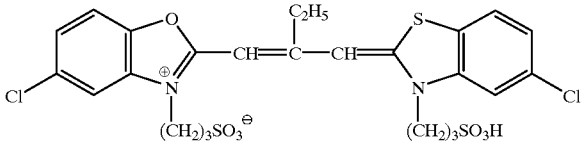
S-3
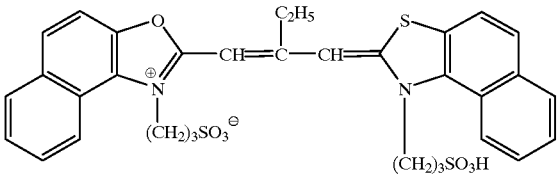

-continued
S-4
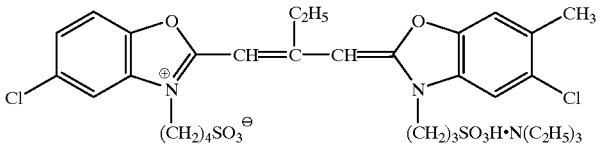
S-5
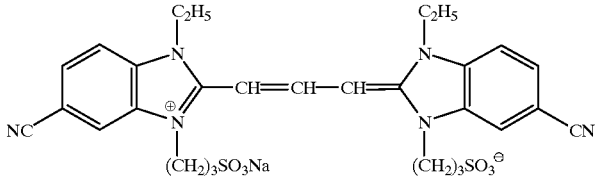
S-6
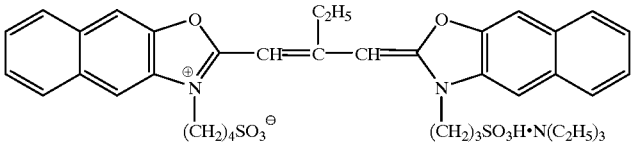
S-7
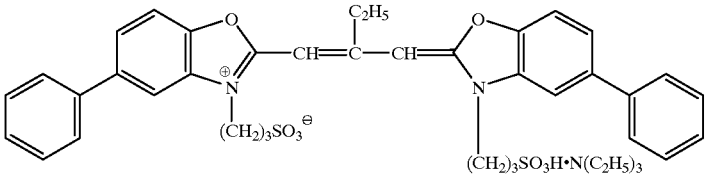
S-8
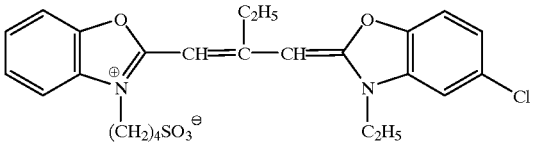
S-9
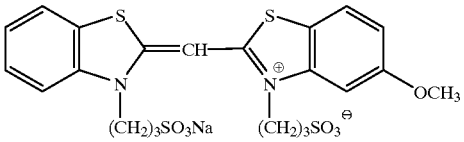
S-10
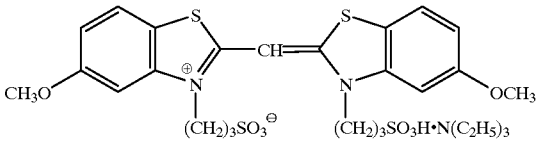
S-11
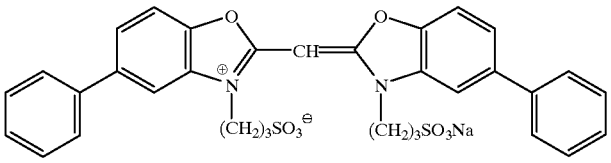
HS-1
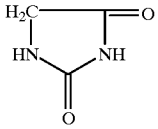
HS-2
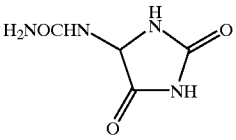
SC-1
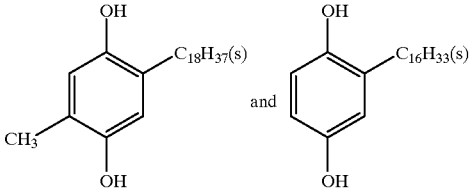
Mixture of (2:3)
Oil-1
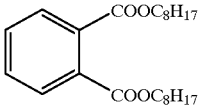

-continued
Oil-2
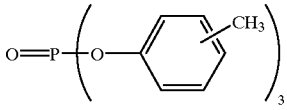
Oil-3
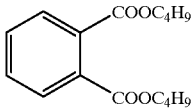
H-1
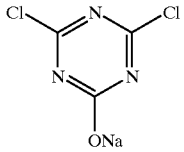
H-2
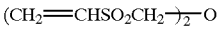
SU-1
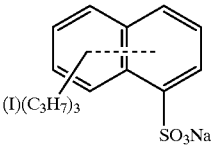
SU-2
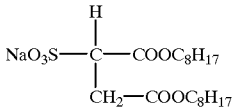
Compound A
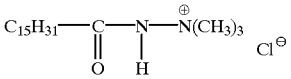
Compound B
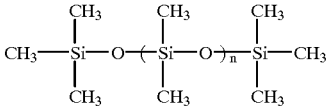
(weight average molecular weight = 30,000)
AI-1
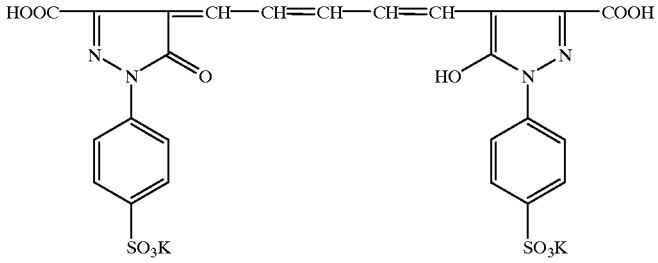
AI-2
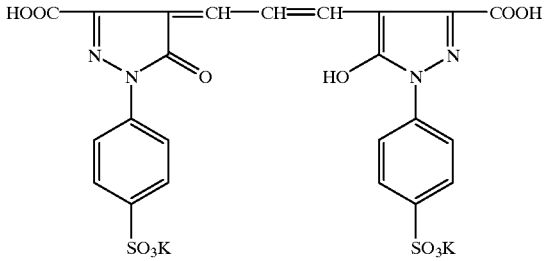
ST-1
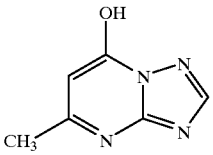
AF-1
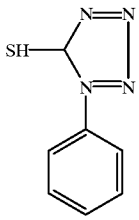
AF-2
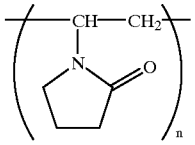

-continued

DI-1

(mixture of the following three components)

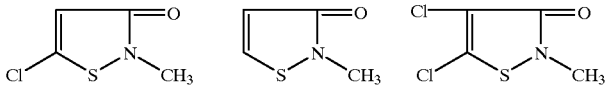

(Component A) (Component B) (Component C)

Component A:Component B:Component C = 50:46:4 (mole ratio)

The color photographic film thus obtained was evaluated for coating fault, flatness and cutting property. Results thereof are shown in the following Table 1.

TABLE 1

| | Polyester resin 1 | | | Polyester resin 2 | | | | |
|---|---|---|---|---|---|---|---|---|
| | Kind | Intrinsic viscosity | Blend ratio | Kind | Intrinsic viscosity | Blend ratio | Tg (° C.) | Atemp (° C.) |
| Comparative Example 1 | PET-A | 0.50 | 1.00 | — | — | — | 80 | 50 |
| Comparative Example 2 | PEN-A | 0.58 | 1.00 | — | — | — | 110 | 80 |
| Comparative Example 3 | PET-A | 0.50 | 0.29 | PEN-A | 0.58 | 0.71 | 101 | 71 |
| Present Invention 1 | PET-B | 0.34 | 0.26 | PET-C | 0.87 | 0.74 | 81 | 51 |
| Present Invention 2 | PET-B | 0.34 | 0.30 | PEN-A | 0.58 | 0.70 | 101 | 71 |
| Present Invention 3 | PEN-C | 0.4 | 0.22 | PEN-B | 0.80 | 0.78 | 111 | 81 |
| Present Invention 4 | PEN-C | 0.4 | 0.48 | PEN-B | 0.80 | 0.52 | 111 | 81 |
| Present Invention 5 | PEN-A | 0.58 | 0.40 | PEN-B | 0.80 | 0.60 | 112 | 82 |
| Present Invention 6 | PEN-D | 0.40 | 0.33 | PEN-B | 0.80 | 0.67 | 106 | 76 |

| | Elastic modulus | | Rupture strength | | | | | |
|---|---|---|---|---|---|---|---|---|
| | Longitudinal direction | Lateral direction | Longitudinal direction | Lateral direction | Cutting property | Coating fault | Flatness | Roll set curl |
| Comparative Example 1 | 510 | 530 | 19 | 21 | ○ | ○ | ○ | x |
| Comparative Example 2 | 660 | 700 | 23 | 25 | x | x | x | ○ |
| Comparative Example 3 | 600 | 620 | 20 | 22 | Δ | Δ | Δ | Δ |
| Present Invention 1 | 520 | 550 | 19 | 21 | ○ | ○ | ○ | Δ |
| Present Invention 2 | 610 | 640 | 20 | 22 | ○ | ○ | ○ | ○ |
| Present Invention 3 | 670 | 710 | 23 | 25 | ○ | ○ | ○ | ○ |
| Present Invention 4 | 670 | 710 | 23 | 25 | ○ | ○ | ○ | ○ |
| Present Invention 5 | 660 | 700 | 24 | 26 | Δ | Δ | ○ | ○ |
| Present Invention 6 | 620 | 650 | 20 | 22 | ○ | ○ | ○ | Δ |

As apparent from the results shown in Table 1, it can be found that according to the present invention, the flatness is excellent and the roll set curl are less liable to occur and the cutting property is improved.

The present invention can provide a photographic support which is excellent in mechanical strength and is less liable to get into roll set curl and which is excellent in cutting property and flatness, and a photographic material using the same.

What is claimed is:

1. A support for photographic material comprising a polyester film having a layer, wherein the layer film comprises two kinds of polyester resins, each of the polyester resins has an intrinsic viscosity of 0.2 to 1.2, and a difference in the intrinsic viscosity between the polyester resins is 0.2 to 0.7.

2. The support of claim 1, wherein the polyester film is a biaxially stretched polyester film.

3. The support of claim 2, wherein the polyester resin having a lower intrinsic viscosity among the polyester resins has an intrinsic viscosity of 0.5 or less, each of the polyester resins has intrinsic viscosity of 0.3 to 1.0, and the difference in the intrinsic viscosity between the polyester resins is 0.2 to 0.7.

4. The support of claim 3, wherein at least one of the polyester resins is polyethylene-2,6-naphthalate.

5. The support of claim 3, wherein the polyester resin having a lower intrinsic viscosity among the polyester resins is blended in a proportion of 10 to 50% by weight, based on the total weight of the polyester resins.

6. The support of claim 5, wherein at least one of the polyester resins is polyethylene-2,6-naphthalate.

7. The support of claim 1, wherein at least one of the polyester resins is polyethylene-2,6-naphthalate.

8. The support of claim 1, wherein the polyester resin having a lower intrinsic viscosity among the polyester resins is blended in a proportion of 10 to 50% by weight, based on the total weight of the polyester resins.

9. The support of claim 1, wherein the polyester resin having a lower intrinsic viscosity among the polyester resins has an intrinsic viscosity of 0.5 or less.

10. The support of claim 1, wherein two kinds of the polyester resins are both polyethylene-2,6-naphthalates.

11. The support of claim 1, wherein each of the polyester resins comprises a dicarboxylic acid component comprising terephthalic acid or 2,6-naphtalenedicarboxylic acid, and a diol component comprising ethylene glycol or cyclohexanedimethanol.

12. The support of claim 1, wherein each of the polyester resins has intrinsic viscosity of 0.3 to 1.0.

13. The support of claim 1, wherein the support has a curl degree of 5 $m^{-1}$ to 50 $m^{-1}$ under the conditions of 23° C. and 20% relative humidity.

14. The support of claim 1, wherein the support has a haze of 3% or less.

15. The support of claim 1, wherein the polyester film has a Tg of 60° C. or more.

16. A photographic material comprising a support of claim 1 and a photosensitive layer.

17. The support of claim 1, wherein the two kinds of polyester resins are polyethylene-2,6-naphthalate and polyethylene terephthalate.

18. A support for photographic material comprising a polyester film, wherein the support has a multilayer structure, and at least one of the layers comprises a mixture of two kinds of polyester resins each of the polyester resins has an intrinsic viscosity of 0.2 to 1.2, and a difference in the intrinsic viscosity between the polyester resins is 0.2 to 0.7.

19. A support for photographic material comprising a polyester film, wherein the polyester film comprises two kinds of polyester resins, each of the polyester resins has an intrinsic viscosity of 0.2 to 1.2, and a difference in the intrinsic viscosity between the polyester resins is 0.2 to 0.7; and wherein the support has a curl degree of 5 $m^{-1}$ to 50 $m^{-1}$ under the conditions of 23° C. and 20% relative humidity.

20. The support of claim 19, wherein the polyester resin having a lower intrinsic viscosity among the polyester resins is blended in a proportion of 10 to 50% by weight, based on the total weight of the polyester resins.

21. The support of claim 20, wherein at least one of the polyester resins is polyethylene-2,6-naphthalate.

22. The support of claim 19, wherein the polyester resin having a lower intrinsic viscosity among the polyester resins has an intrinsic viscosity of 0.5 or less.

* * * * *